US006513508B2

(12) United States Patent
Fischer et al.

(10) Patent No.: US 6,513,508 B2
(45) Date of Patent: Feb. 4, 2003

(54) FLUID FEED DUCT FOR A HOT FLUID IN A HOLLOW STRUCTURE

(75) Inventors: Jochem Fischer, Marbach (DE); Helmut Neuschwander, Ludwigsburg (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 10/045,031

(22) Filed: Jan. 15, 2002

(65) Prior Publication Data

US 2002/0112708 A1 Aug. 22, 2002

Related U.S. Application Data

(63) Continuation of application No. PCT/EP00/05984, filed on Jun. 28, 2000.

(30) Foreign Application Priority Data

Jul. 15, 1999 (DE) ..... 199 33 030

(51) Int. Cl.[7] ..... F02M 25/07
(52) U.S. Cl. ..... 123/568.17
(58) Field of Search ..... 123/568.11, 568.17, 123/568.18, 184.21

(56) References Cited

U.S. PATENT DOCUMENTS 3,989,018 A * 11/1976 Beir ..... 123/568.17
4,135,481 A * 1/1979 Resler, Jr. ..... 123/568.17
5,207,714 A * 5/1993 Hayashi et al. ..... 123/568.17
5,493,104 A * 2/1996 Elder et al. ..... 123/568.17
5,957,116 A * 9/1999 Haegele et al. ..... 123/568.17
5,970,960 A * 10/1999 Azuma ..... 123/568.17
6,152,115 A * 11/2000 Busato et al. ..... 123/568.17

FOREIGN PATENT DOCUMENTS

EP 0486338 5/1992
EP 0886063 12/1998

* cited by examiner

*Primary Examiner*—Willis R. Wolfe
(74) *Attorney, Agent, or Firm*—Crowell & Moring LLP

(57) ABSTRACT

A fluid feed duct, which may be used for feeding a stream of recirculated exhaust gas into a stream of intake air for an internal combustion engine. The feed duct includes a hollow structure (10) into which a feed connection (12) is introduced via a joint structure (34). A ceramic pipe (16) is used to prevent heat from the exhaust gas stream from being conducted to mounts in the hollow structure (10) which represents the intake duct of the engine. Consequently, the intake duct can be manufactured of a thermoplastic synthetic resin material, since the risk of thermal overstressing is avoided. The feed connection also has a deflecting segment (19) which is provided in its sides with outlet openings (20). This enables the exhaust gas to be introduced in the direction of flow of the intake air, so that optimal mixing is assured and the hot exhaust gas stream is prevented from passing directly to the wall of the thermoplastic intake duct, thereby preventing the intake duct from being melted.

9 Claims, 3 Drawing Sheets

FLUID FEED DUCT FOR A HOT FLUID IN A HOLLOW STRUCTURE

CROSS REFERENCE TO RELATED APPLICATIONS

This application is a continuation of international patent application no. PCT/EP00/05984, filed Jun. 28, 2000, designating the United States of America, the entire disclosure of which is incorporated herein by reference. Priority is claimed based on Federal Republic of Germany patent application no. DE 199 33 030.1, filed Jul. 15, 1999.

BACKGROUND OF THE INVENTION

The invention relates to a fluid feed duct, which is suitable particularly for recirculating exhaust gas into the intake system of an internal combustion engine.

The recirculation of exhaust gases into the intake tract of an internal combustion engine is known in the art. This measure is taken to reduce the emission of harmful pollutants from the internal combustion engine. A problem, however, is the high temperature of the exhaust gas. Particularly if the intake tract is made of thermoplastic synthetic resin material, the introduced exhaust gas can cause the intake tract to melt in the area of the exhaust gas feed.

To prevent thermal overstressing of the intake tract, EP 486,338 proposes a double wall design for the exhaust gas feed duct. The exhaust gas is fed through the inside pipe into the intake tract. The hollow space resulting between the double wall has an insulating effect with respect to the junction between the exhaust gas feed duct and the intake pipe.

To achieve an additional cooling effect, a portion of the fresh intake air is guided through this gap. The fresh intake air is removed from a point in front of a throttle valve and reaches the gap via a bypass line. The cooling air returns to the intake tract through corresponding openings parallel to the exhaust gas stream.

This proposed solution, however, does not allow the proportion of recirculated exhaust gas to transmitted combustion air to be increased at any desired ratio. The double-walled pipe is connected directly with the intake pipe, so that at higher recirculation rates, there is nevertheless a risk that the wall of the intake tract may melt. Also, the hot exhaust gas stream directly strikes the opposite wall of the intake tract, which creates another area of high thermal stressing and may cause the component to fail.

To prevent this, the design proposed in EP 886 063 A2 provides a gas conduction element 26 (cf. FIG. 2), which can withstand the thermal stress and protects the wall of the intake tract against direct impingement of the hot exhaust gas stream. Within this gas conduction element the hot exhaust gas stream has sufficient time to mix with the intake air. However, such an additional component increases the design complexity as well as the weight of the intake tract. Both are undesirable in view of the greatest possible economic efficiency, which is the aim in the production and the use of the intake tract.

To obviate these drawbacks, the Automobiltechnische Zeitschrift, Volume 1992, p. 530 proposes to fasten hot pipes to plastic components. This hot pipe is again a double-walled pipe, but the inner pipe ends earlier than the outer pipe. This achieves an ejector effect, so that cooling air from the intake tract can be sucked through the gap of the double-walled pipe. Thus, the intake point is cooled and the cooling air simultaneously mixes with the exhaust gas stream and thereby cools the exhaust gas.

Even in this exhaust gas recirculation design, however, the realizable exhaust gas recirculation rates have an upper limit. To make the cooling gas stream possible, it is necessary to mount the exhaust gas recirculation pipe on a collar that merges directly into the locating flange for the exhaust gas feed duct on the intake manifold. At high exhaust gas recirculation rates, this heat bridge causes excessive thermal stressing of the intake tract in the area of the exhaust gas recirculation. Moreover, although the exhaust gas stream is being cooled, a gas guidance element in accordance with EP 886 063 must be provided in the intake tract if a certain exhaust gas recirculation rate is exceeded.

SUMMARY OF THE INVENTION

Thus, the object of the invention is to provide a fluid feed duct for conducting hot fluids into a hollow structure for transmitting a cooler fluid.

Another object of the invention is to provide a fluid feed duct arrangement which is cost effective to produce.

A further object of the invention is to provide a fluid feed duct which permits a high rate of introduced hot fluid in proportion to the transmitted fluid, while maintaining the thermal stressing of the hollow structure within the required limits.

These and other object of the invention are achieved by providing a fluid feed duct for recirculating engine exhaust gas into an intake tract of an internal combustion engine comprising a hollow structure for transmitting a fluid from an inlet to an outlet; a feed connection projecting interiorly into the hollow structure for introducing into the hollow structure a fluid that is hotter than the transmitted fluid, and a joint structure for sealingly mounting the feed connection inside the hollow structure, in which the feed connection and the joint structure have greater heat resistance than the hollow structure; the feed connection is heat-resistant to the introduced fluid; an end area of the feed connection points in the flow direction of the transmitted fluid, and sides of the end area around which the transmitted fluid flows are provided with outlets opening into the interior of the hollow structure.

In accordance with a further aspect of the invention, the objects are also achieved by providing a fluid feed duct for recirculating engine exhaust gas into an intake tract of an internal combustion engine comprising a hollow structure for transmitting a fluid from an inlet to an outlet; a feed connection for introducing into the hollow structure a fluid that is hotter than the transmitted fluid, and a joint structure for sealingly mounting the feed connection inside the hollow structure; wherein the feed connection and the joint structure have greater heat resistance than the hollow structure; the feed connection is heat-resistant to the introduced fluid, and means are provided to reduce the heat transfer from the feed connection to the joint structure.

According to the invention, the feed connection of the feed duct in the end area extending into the interior of the hollow structure is provided with outlet openings pointing in the flow direction of the transmitted fluid. This design measure causes the flow of the introduced fluid to be diverted in flow direction inside the hollow structure, which prevents the introduced fluid stream from striking a wall of the hollow structure. Using the ejector effect, the introduced fluid is caught and entrained by the flow of the transmitted fluid, so that rapid mixing occurs. This mixing simultaneously cools the introduced fluid and heats the transmitted fluid. The resultant temperature, however, falls within the range of the permissible thermal stressing of the hollow structure wall.

The outlet openings are arranged along the sides in the end area of the feed connection. The fact that there is a plurality of these openings enhances the mixing effect since the stream of the introduced fluid is broken up into many small partial streams.

In accordance with a further embodiment of the invention, the outlet openings are provided with baffles. Particularly if the feed connection is made of sheet metal, these baffles can be simply produced by stamping. The baffles are preferably bent into the interior of the feed connection and thereby cause optimal mixing of the introduced fluid with the transmitted fluid. In addition, the baffles cause the introduced fluid to be injected as it exits along the end area of the feed connection, so that direct contact of the introduced fluid with the walls of the hollow structure is avoided. This contact occurs only after a sufficient mixing path in the continued course of the transmitted flow inside the hollow structure.

To further promote the mixing of the two fluids, it is advantageous to provide the feed connection with a flow-optimized outer contour relative to the transmitted flow inside the hollow structure. As the fluid flows around the feed connection, a laminar flow is then created along the outer contour of the feed connection, particularly its end area. This improves the mixing result with the introduced fluid.

A particularly advantageous embodiment of the fluid feed duct is obtained if the end area of the feed connection points in the flow direction of the transmitted fluid and the sides of this end area are provided with outlet openings opening into the interior of the hollow structure around which the fluid flows, and if preferably ceramic means also are provided to reduce the heat transfer from the feed connection to the joint structure which sealingly mounts the feed connection inside the hollow structure. This prevents to the greatest extent the risk of thermal overstressing of the hollow structure both in the area of the junction to the feed connection and in the area of the fluid-carrying wall parts. However, even if the measures are used individually, depending on the application, they can provide a satisfactory solution. The shaping of the end area of the feed connection is not necessary, for instance, if the fluid is fed into a wide hollow space, so that the wall of the hollow structure opposite the feed connection is remote. In contrast, if the hollow structures are particularly narrow, it may only be necessary to take the measure along the end area of the feed connection, while heat conduction at the feed connection remains non-critical.

In a further embodiment of the invention, the end area of the feed connection is formed by a pipe segment, which is provided with outlet openings along the sides around which the fluid flows. The cross section of the pipe segment need not be circular; various cross sectional shapes are feasible. The pipe segment can be produced by injection molding. Another option is to produce it from a tubular semi-finished product that is deflected. In this case, the openings have to be created, for instance, by stamping. The pipe segment is furthermore provided with a plug-in connection by means of which it can be pushed onto the feed connection. This makes it also possible to retrofit this component to an existing intake system.

According to a further embodiment of the invention, the pipe segment is open at its end. This is useful in an embodiment of the pipe segment made of a tubular semi-finished product. The open pipe end serves as an additional intake opening for the recirculated exhaust gas.

An alternative fluid feed duct consists of three structural function areas: the hollow structure, the feed connection and the joint structure. The hollow structure is suitable for transmitting a fluid and can, for instance, consist of an intake pipe for an internal combustion engine. The feed connection is suitable for connection to a feed line with the introduced hot fluid being conducted through the feed line. Provided in addition is a joint structure, which on the one hand serves to mount the feed connection to the wall of the hollow structure and on the other hand provides a seal between these two components.

The described fluid feed duct must be designed to withstand the thermal stresses caused by the introduction of the hot fluid. This means that the feed connection must be heat resistant to the introduced fluid. Materials with a lower melting point, however, e.g., plastics, are frequently used for the hollow structure. Since the introduced fluid heats the feed connection to a high temperature, the junction between the feed connection and the hollow structure must be sufficiently insulated so that the hollow structure is not subject to excessive thermal stressing in this area. This is why the joint structure is provided, so that heat from the feed connection is conducted to the hollow structure via this joint structure. A temperature gradient in the joint structure is established starting from the feed connection toward the hollow structure, so that the contact surface between the joint structure and the hollow structure is cooler than the feed connection.

According to the invention, the temperature is further lowered at the junction between the hollow structure and the joint structure by providing means to prevent heat from being conducted from the feed connection to the joint structure. This naturally also reduces the thermal stressing of the junction between the joint structure and the hollow structure. This achieves higher exhaust gas recirculation rates than would be possible in a fluid feed duct without means for reducing such heat transfer. The required exhaust gas recirculation rates for diesel engines can in part be as high as 60%, which in a plastic intake tract is possible only if the aforementioned means are being used.

According to one advantageous embodiment of the invention, the means for reducing the heat transfer from the feed connection is made of ceramic. This material is sufficiently heat resistant against the introduced hot fluid. The thermal conductivity of ceramics, however, is substantially lower than that of the metallic materials typically used for the feed connection. The feed connection thus acts as a thermal insulator, so that a smaller amount of heat is transferred to the joint structure.

It is advantageous if the joint structure is also made of ceramic. This prevents excessive heat conduction in this area as well. The feed connection and the joint structure can be made as a single part, which advantageously lowers the production costs.

A further embodiment of the means for reducing heat transfer consists of a double-wall design of the feed connection. The feed connection has an inner wall and an outer wall and the fluid located in the gap between these two walls acts as an insulator. The introduced fluid is guided through the cross section formed by the inner wall.

To use the gap as an insulator to reduce heat transfer to the joint structure, the joint structure is mounted to the outer wall of the feed connection. The insulating effect of the gap can be enhanced if the described embodiment of the invention is combined with the ejector effect, which is known from the prior art. This results in a continuous exchange of the fluid within the gap and prevents it from being heated. Consequently, the outer wall remains cooler, so that less heat is being transferred to the joint structure.

According to a modification of the invention, it is also possible to influence the temperature gradient in the joint structure. This is accomplished by using means for enlarging the surface of the joint structure. This increases the amount of heat being radiated, which is proportional to the surface of the joint structure, so that the junction between the joint structure and the hollow structure heats up less. To enlarge this surface, the joint structure can be made, for instance, of thin sheet metal, which is given a bellows-type structure. The corrugated walls of this bellows-type structure provide sufficient rigidity and simultaneously enlarge the surface. Another option is to use a dish-type design of the joint structure, in which case the outer radius of the dish is selected larger than would be necessary to install the feed connection. This dish can also be made of thin sheet metal and stiffened by beads. The beads simultaneously cause the surface to be further increased.

For large-scale production, the joint structure, according to an advantageous embodiment of the inventive concept, is constructed as a bayonet lock. This creates a module that can be simply integrated into hollow structures. Particularly if the hollow structures are made of synthetic resin material, the corresponding recess, as the counter part of the bayonet lock, can be simply integrated into the wall structure. The feed connection and the joint structure can then be designed as a standard component, so that high numbers of units can be achieved. This increases the economic efficiency of the solution. The bayonet lock makes it easy to mount the fluid feed duct, and the reduced assembly costs further increase the economic efficiency of the fluid feed duct.

The described embodiments are suitable to reduce the thermal stressing of the junction between the feed connection and the hollow structure, so that in proportion to the transmitted fluid a higher amount of hot fluid can be introduced. In the application as an exhaust gas recirculation device, this means higher exhaust gas recirculation rates in the intake air for combustion. This implies not only higher thermal stressing of the junctions but also of the remaining hollow structure since the recirculated fluid inside the hollow structure cools along the walls of the hollow structure. As a result, the thermal stress limits of the hollow structure can be exceeded in these areas as well. This is the case particularly if the recirculated fluid stream can strike the wall of the hollow structure unhindered.

These and other features of preferred embodiments of the invention, in addition to being set forth in the claims, are also disclosed in the specification and/or the drawings, and the individual features each may be implemented in embodiments of the invention either alone or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
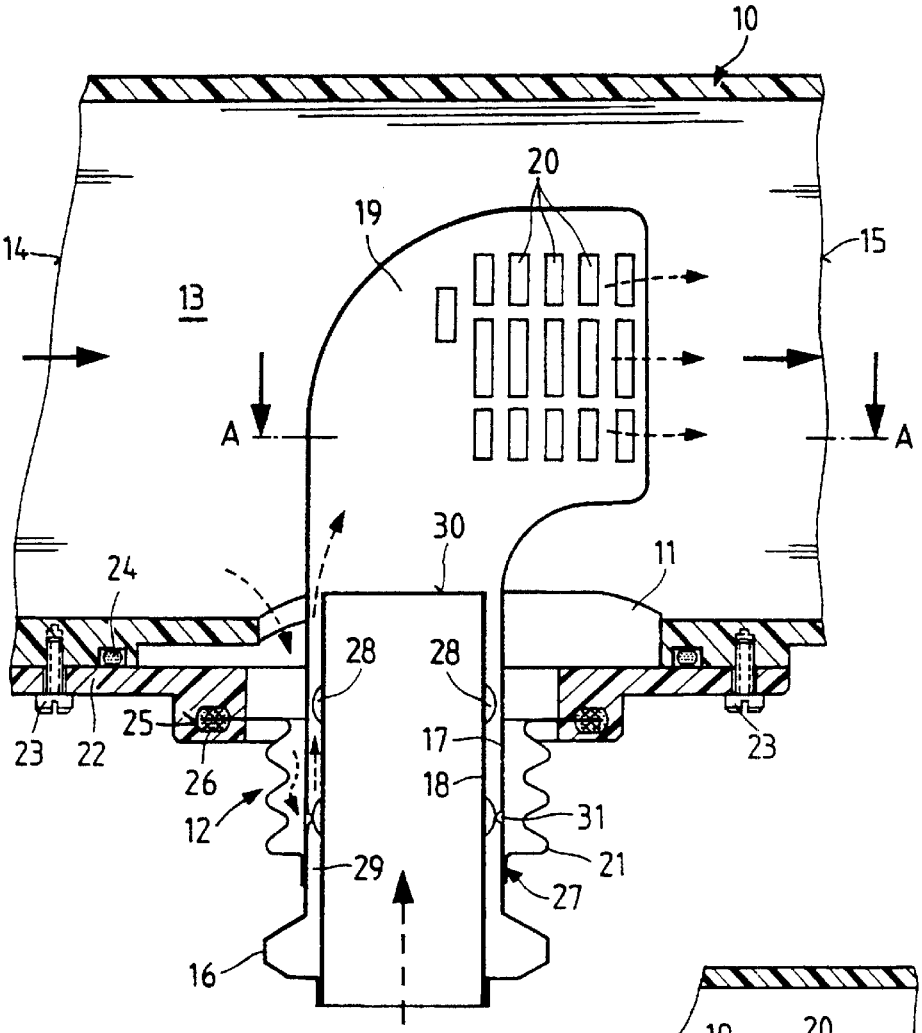
FIG. 1 is a longitudinal section through a fluid feed duct comprising an intake pipe into which projects a double-walled feed connection with an angled end area.

The fluid feed duct according to FIG. 1 represents the recirculation of the exhaust gas into the intake tract of an internal combustion engine. A hollow structure 10 is embodied as a pipe segment of the intake tract. This hollow structure has a cutout 11 through which a feed connection 12 can be pushed into an interior 13 of the hollow structure. The edges should be understood as inlet 14 and outlet 15, so that combustion air can flow through the hollow structure as indicated by the solid arrows.

The feed connection 12 comprises a connection 16 for an exhaust gas recirculation line, which is co-formed by an outer pipe 17 of a double-walled pipe structure. An associated inner pipe 18 is provided for conducting the exhaust gas, which is represented by a broken line arrow. The inner pipe 18 opens out into an end area 19 of the feed connection 12 and has outlet openings 20 to introduce the exhaust gas into the air stream of the hollow structure. The introduction of the exhaust gas is also indicated by dashed arrows. A sheet metal bellows 21 joining the feed connection 12 to the hollow space 10 is firmly connected with the outer pipe 17. In this context, a cover 22 fixed with screws 23 and sealed by means of an O-ring 24 also forms part of the hollow structure. An outer edge 25 of the sheet metal bellows is provided with a Teflon ring 26, which in turn is injected into cover 22. This Teflon ring is more heat resistant than the cover, so that a certain heat transfer via the sheet metal bellows does not damage the entire device. An inner edge 27 of the sheet metal bellows 21 is connected directly to the outer pipe 17, e.g., by soldering.

To fix the inner pipe 18 inside the outer pipe 17, the inner pipe 18 is provided with beads 28 that are connected to its outer walls. An annular space 29 formed by the inner pipe and the outer pipe has an insulating effect and is simultaneously used for the passage of intake air. This intake air is sucked through the annular space 29, which it had previously entered through inlet bores 31, due to an ejector effect at the inner pipe end 30. Along the path to the inlet bores, the intake air can also cool the insides of the sheet metal bellows. The path of the cooling air stream is indicated by dotted arrows.

Figure 2:
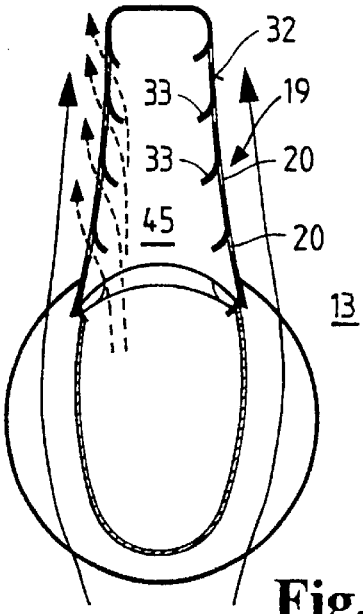
FIG. 2 is a sectional view taken along section line A—A of FIG. 1.

The construction of the end area 19 is illustrated in FIG. 2. This end area forms an elongated hollow space around which flows the fluid inside the hollow structure 10 (solid arrows). The hollow space 45 has outlet openings 20 communicating with the interior 13, through which the exhaust gas stream (dashed arrows) can be introduced in the direction of the intake airflow. The exhaust gas stream initially still contacts the sides 32 of the end area 19 before it gradually mixes with the intake airflow. The end area is made of sheet metal. The openings can be simply produced by notching the material and bending it inwardly. This creates baffles 33, which facilitate an unimpeded exit of the exhaust gas through the outlet openings 20.

Figure 3:
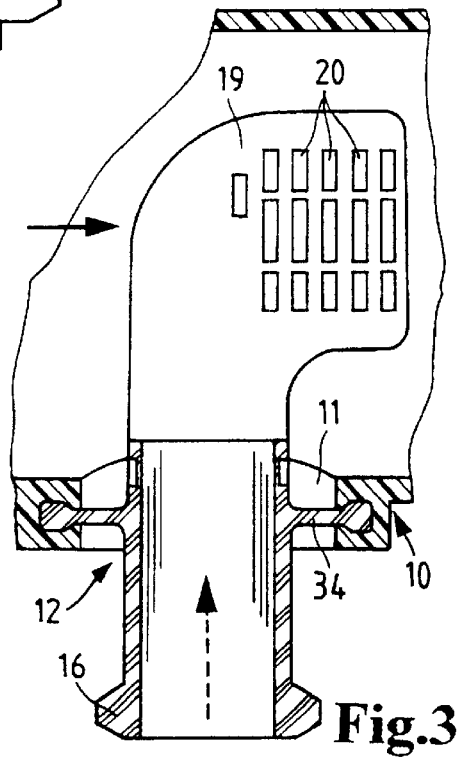
FIG. 3 is a longitudinal section through a fluid feed duct with a feed connection made of ceramic material.

FIG. 3 shows a two-part feed connection 12. The first part is the end area 19, which is configured according to FIG. 1. It is directly connected with a ceramic component, which combines the functions of connection 16 and a junction plate 34 for mounting inside the hollow structure 10. The ceramic material of this component acts as an insulator, so that only a small amount of the heat from the introduced exhaust gas (dashed arrow) is transferred to the hollow structure 10.

The feed connection 12 is molded directly into the cutout 11 of the hollow structure 10 via the ceramic plate. This results in a component that is simple to produce. Due to the two-part design, the geometry of the feed connection is very simple. The feed connection can be fixed in corresponding recesses in the mold so that it can be directly injected during the injection molding process of the hollow structure. This completely eliminates the final assembly costs.

Figure 4:
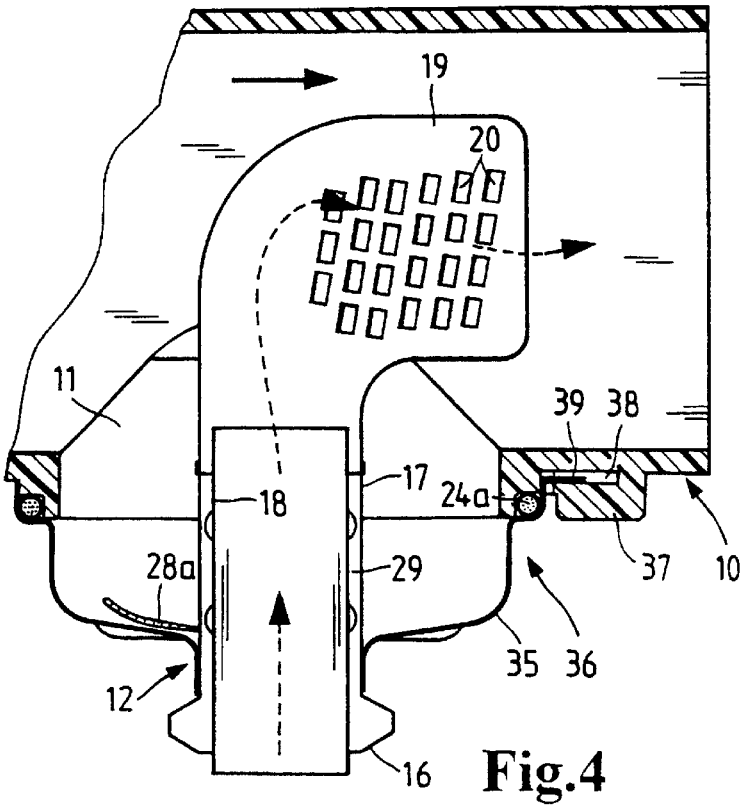
FIG. 4 is a longitudinal section through a fluid feed duct according to FIG. 1, which is distinguished by an angled arrangement of the outlet openings and by a different design of the joint structure.

The feed connection 12 according to FIG. 4 has a double-wall structure corresponding to the embodiment shown in FIG. 1, comprising an inner pipe 18 and an outer pipe 17. However, there is no cooling air stream flowing around this structure (compare dotted arrow in FIG. 1). The gas located inside the annular space 29 is therefore not constantly exchanged but acts nevertheless as an insulator between the outer and the inner pipe.

Fixed to the outer pipe 17 is a sheet metal bell 35, which serves to fix the feed connection 12 to the hollow structure 10. An O-ring 24*a* provides a seal between the sheet metal bell 35 and the cutout 11. For rigidity, the sheet metal bell 35 is provided with beads 28*a*.

In contrast to the other embodiments, the openings 20 are arranged at an angle. This measure serves to correct the direction of the exiting exhaust gas stream in the direction of the intake airflow inside the hollow structure. This is necessary because the deflection in the end area 19 imparts a twist to the exhaust gas stream. To prevent the exhaust gas stream from contacting the walls of the hollow structure as long as possible after exiting from this end area, the angular momentum is negated by means of oblique baffles arranged in the outlet openings 20. This process is indicated by the broken line arrows.

Figure 5:
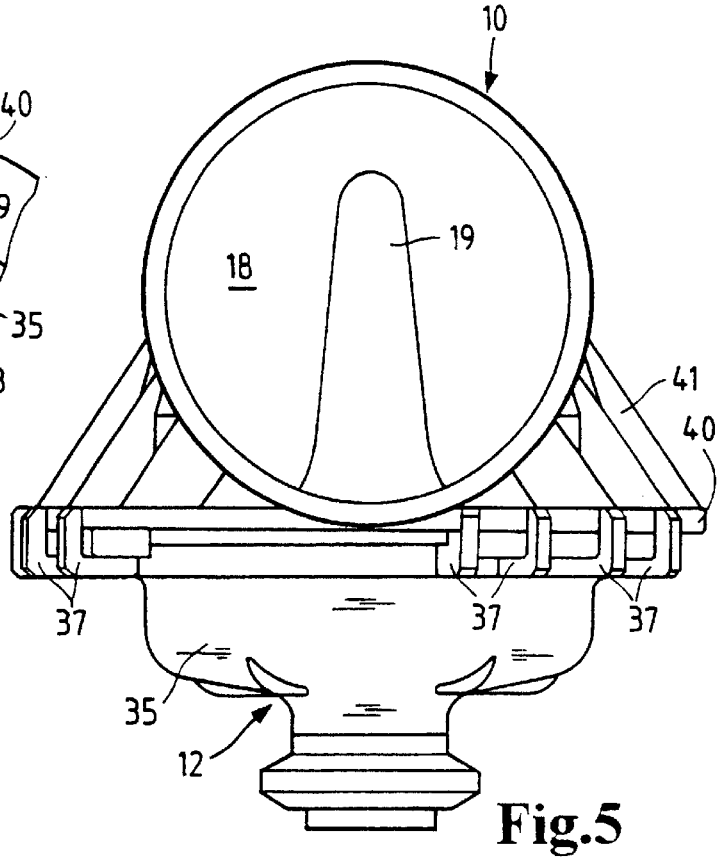
FIG. 5 is a top view from the rear onto the feed connection, which is mounted inside the intake pipe.

The connection between the sheet metal bell 35 and the hollow structure 10 is provided by a bayonet lock 36, the mode of action of which is best understood with the aid of FIGS. 4 and 5. Locating ribs 37 are arranged all around the cutout 11 on the hollow structure 10. These locating ribs have slots 38 into which slips a clip 39 that is arranged radially along the outer periphery of the sheet metal bell 35 when the feed connection 12 is rotated. This causes the sheet metal bell 35 to be pressed against O-ring 24*a*. The locating ribs 37 are mounted to a locating flange 40, which adjoins the cutout 11 and is stabilized toward the hollow structure by support ribs 41. The flow-optimized configuration of the end area is clearly evident.

FIG. 5 also shows the contour of the end area 19, which represents the part of the feed connection 12 that projects into the interior 13. The view into the interior 13 is in flow direction of the intake air (see solid arrow in FIG. 4).

Figure 6:
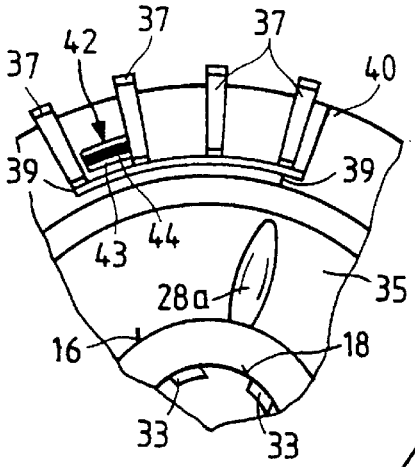
FIG. 6 shows a detail of the bayonet lock of the fluid feed duct according to FIGS. 4 and 5.

FIG. 6 is a detail of the top view onto the feed connection in the direction of the introduced exhaust gas (compare dashed arrow in FIG. 4). Visible are inner pipe 18, connection 16, one of beads 28*a* inside the sheet metal bell 35, the edges of clip 39, which is pushed under the locating ribs 37, and a locking element 42 comprising a recess 43 between locating ribs 37, into which snaps a protruding sheet-metal tongue 44, which forms part of clip 39. Also visible are the ends of the baffles 33 in the interior of the pipe.

Figure 7:
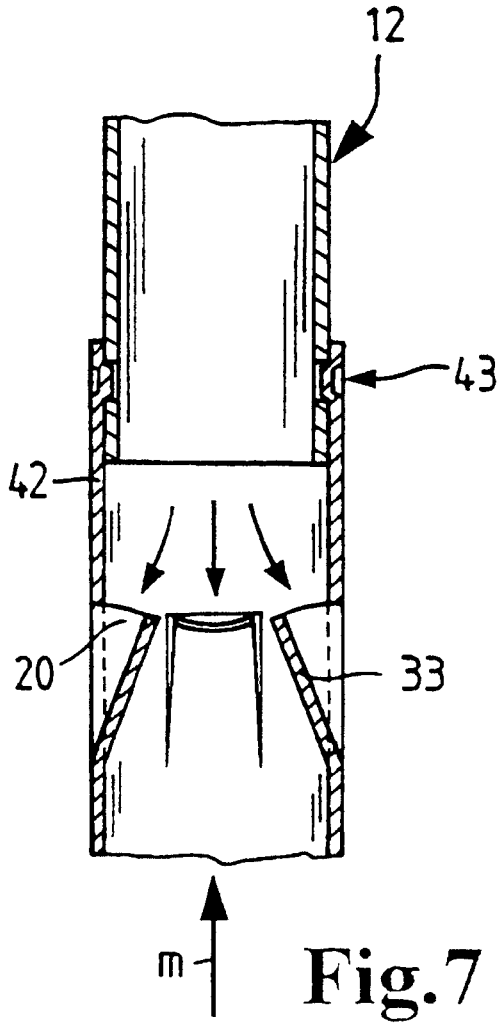
FIG. 7 is a sectional view through the end area of the fluid feed duct constructed as a pipe segment.
Figure 8:
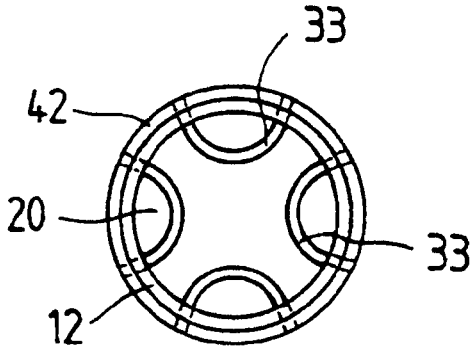
FIG. 8 is an end view of the pipe segment viewed in the direction of arrow m of FIG. 7.

FIGS. 7 and 8 show an alternative feed connection 12, which projects into an intake system (not depicted) in flow direction of the intake air. Pushed onto the feed connection by means of a plug-in connection 43 is a pipe fitting 42, which forms the end area of the feed connection. The outlet openings 20 are pushed into the pipe segment, which is produced from a tubular semi-finished product, creating baffles 33 in the form of tongues. The end of the pipe segment 42 is open so that the recirculated exhaust gas can be introduced into the intake tract through this opening as well.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A fluid feed duct for recirculating engine exhaust gas into an intake tract of an internal combustion engine comprising a hollow structure for transmitting a fluid from an inlet to an outlet; a feed connection for introducing into the hollow structure a fluid that is hotter than the transmitted fluid, and a joint structure for sealingly mounting the feed connection inside the hollow structure; wherein the feed connection and the joint structure have greater heat resistance than the hollow structure; the feed connection is heat-resistant to the introduced fluid, and means are provided to reduce the heat transfer from the feed connection to the joint structure, wherein the feed connection is double-walled; the introduced fluid is guided through an inner pipe of the double-walled feed connection; the joint structure is mounted to an outer pipe of the double-walled feed connection, and the means for reducing the heat transfer is an annular space between the inner pipe and the outer pipe.

2. A fluid feed duct for recirculating engine exhaust gas into an intake tract of an internal combustion engine comprising a hollow structure for transmitting a fluid from an inlet to an outlet; a feed connection for introducing into the hollow structure a fluid that is hotter than the transmitted fluid, and a joint structure for sealingly mounting the feed connection inside the hollow structure; wherein the feed connection and the joint structure have greater heat resistance than the hollow structure; the feed connection is heat-resistant to the introduced fluid, and means are provided to reduce the heat transfer from the feed connection to the joint structure, wherein the means for reducing the heat transfer comprise the feed connection being made of ceramic material.

3. A fluid feed duct according to claim 2, wherein the feed connection and the joint structure are a single unitary part made of ceramic material.

4. A fluid feed duct for recirculating engine exhaust gas into an intake tract of an internal combustion engine comprising a hollow structure for transmitting a fluid from an inlet to an outlet; a feed connection projecting interiorly into the hollow structure for introducing into the hollow structure a fluid that is hotter than the transmitted fluid, and a joint structure for sealingly mounting the feed connection inside the hollow structure; wherein the feed connection and the joint structure have greater heat resistance than the hollow structure; the feed connection is heat-resistant to the introduced fluid; an end area of the feed connection points in the flow direction of the transmitted fluid, and sides of said end area around which the transmitted fluid flows are provided with outlets opening into the interior of the hollow structure.

5. A fluid feed duct according to claim 4, wherein the outlets are provided with baffles to influence the flow direction of the introduced fluid.

6. A fluid feed duct according to claim 4, wherein the feed connection where it projects into the interior of the hollow structure, has an outer contour configured to optimize flow of the transmitted fluid.

7. A fluid feed duct according to claim 4, wherein the end area of the feed connection comprises a pipe segment mounted to the feed connection via a plug-in connection.

8. A fluid feed duct according to claim 7, wherein the pipe segment has an open end.

9. A fluid feed duct according to claim 4, wherein the joint structure is connected to the hollow structure by a bayonet lock.

* * * * *